United States Patent [19]

Gilano et al.

[11] 4,129,758

[45] Dec. 12, 1978

[54] KEYBOARD SWITCH ASSEMBLY HAVING FLEXIBLE CONTACT CARRYING MEMBER BETWEEN CONTACT CARRYING SUBSTRATE AND FLEXIBLE, RESILIENT, KEY-DEPRESSIBLE BUBBLE PROTRUSIONS

[75] Inventors: Michael N. Gilano, Newport Beach; James C. Hayes, Irvine, both of Calif.

[73] Assignee: Telaris Telecommunications, Inc., Irvine, Calif.

[21] Appl. No.: 805,345

[22] Filed: Jun. 10, 1977

[51] Int. Cl.[2] ..... H01H 13/70

[52] U.S. Cl. ..... 200/5 A; 200/159 B; 200/330; 200/340

[58] Field of Search ..... 200/1 R, 5 R, 5 A, 159 R, 200/159 A, 159 B, 340, 329, 330, 338, 340

[56] References Cited

U.S. PATENT DOCUMENTS

| | | | |
|---|---|---|---|
| 3,773,998 | 11/1973 | Seeger, Jr. et al. | 200/159 B |
| 3,777,082 | 12/1973 | Hatley et al. | 200/159 B X |
| 3,780,237 | 12/1973 | Seeger, Jr. et al. | 200/5 A |
| 3,856,998 | 12/1974 | Sims, Jr. | 200/5 A |
| 3,860,771 | 1/1975 | Lynn et al. | 200/5 R X |
| 3,862,382 | 1/1975 | Glaister et al. | 200/5 A |
| 3,898,421 | 8/1975 | Suzumura | 200/159 B |
| 3,978,297 | 8/1976 | Lynn et al. | 200/5 A |
| 3,987,259 | 10/1976 | Larson | 200/5 A |
| 3,993,884 | 11/1976 | Kondur et al. | 200/340 X |
| 3,995,126 | 11/1976 | Larson | 200/5 A |

*Primary Examiner*—James R. Scott

*Attorney, Agent, or Firm*—Fraser and Bogucki

[57] ABSTRACT

A keyboard switch assembly for use in telephones, calculators and the like positions a thin, flexible dielectric member with a switch closure conductive pattern printed thereon between substrate switch contacts and flexible bubble actuator mechanisms. The separate switch closure member permits the closure conductor pattern to be selected independently of constraints for proper bubble operation while permitting the flexible bubbles to be designed independently of requirements for switch closure patterns for optimum switch assembly design and operation.

1 Claim, 1 Drawing Figure

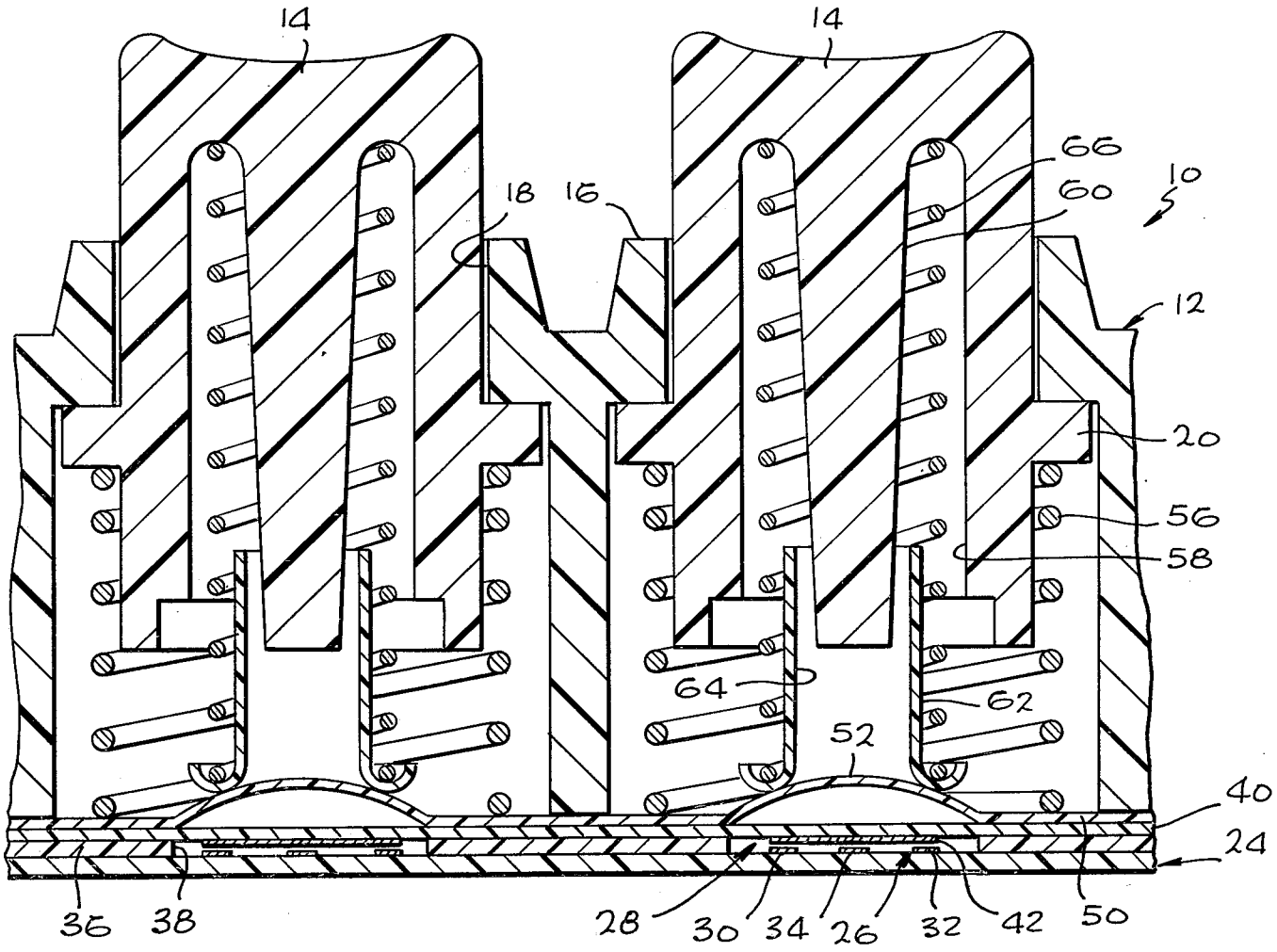
10
12
14
14
16
18
20
24
26
28
30
32
34
36
38
40
42
50
52
56
58
60
62
64
66

KEYBOARD SWITCH ASSEMBLY HAVING FLEXIBLE CONTACT CARRYING MEMBER BETWEEN CONTACT CARRYING SUBSTRATE AND FLEXIBLE, RESILIENT, KEY-DEPRESSIBLE BUBBLE PROTRUSIONS

BACKGROUND OF THE INVENTION

1. Field of the Invention

The present invention relates to keyboard switch assemblies which provide for momentary electrical contact in response to actuation of keys, and more particularly to keybcard switch assemblies of the type employing printed circuit patterns on thin, planar substrate materials which are momentarily driven into contact by depression of spring loaded pushbuttons.

2. History of the Prior Art

In order to be competitive in a high volume market such as the calculator market or the telephone market a keyboard switch assembly must satisfy a large number of conflicting demands. It should be compact, lightweight, very inexpensive, and highly reliable and have a satisfying touch to the operator. While electronic debouncing circuits are available, the economics of a particular use or the requirements of a particular customer frequently necessitate the use of a virtually bounce-free switch assembly. That is, a single, unambiguous contact closure signal is required for each activation of a keyboard key. The problem of providing a bounce-free operation becomes worse in multi-pole switch assemblies such as arrangements wherein a single key actuation must connect separate row and column conductors to a common voltage. Bounce-free operation is one factor amoung several which combine to define a force-displacement characteristic for the key. The characteristic relates to other factors as well, such as ease of depression of the key, tactile feel and percentage contact. Ease of depression of the key is generally desirable so as to bring this parameter within a desirable force range. For example, telephone companies often specify that the keys of a tone generating telephone should be operated by a force of 100–200 grams. In addition to reducing the bounce to a minimum so as to avoid generation of more than the single signal desired with each key depression, it is desirable to reduce the tactile feel of the key. Percentage of travel before contact is dictated by such things as application of the keyboard. For example, in the case of tone generating telephones, a desirable percentage of travel before contact might be such that the switch actuates after key displacement is approximately 50% of maximum travel and releases when the key displacement becomes less than about 30% of its maximum travel.

Some of the various factors involved in the successful operation of keyboard contacts are discussed in detail in an article by R. L. Deninger entitled "Human Factors Engineering Studies of the Design and Use of Pushbutton Telephone Sets", Bell System Technical Journal, July 1960, p. 995 et seq. Other factors such as contact arcing are discussed in an article entitled "Making and Breaking of Circuits is Analyzed by a Dozen Experts" in Product Engineering, December 1975, p. 37 et seq.

A variety of keyboard switch assembly arrangements have been developed in an attempt to meet the demands of the keyboard market. These include arrangements described in the following U.S. Pat. Nos. 3,699,294 to Sudduth, 3,783,205 to Boulanger, 3,780,237 to Seeger, Jr. et al, and 3,860,771 to Lynn et al. The Sudduth patent discusses the problem of bounce and minimization thereof. In the Seeger, Jr. et al patent each key is provided with a slideable plunger and included spring in addition to the main key spring to achieve certain advantages including minimization of damage to the moving parts of the switch resulting from excessive force or crushing. The arrangements shown in the patents to Lynn et al and Boulanger are typical of the state of the art in keyboard switch assemblies of the type used in tone producing telephones and in calculators. Such arrangements employ a laminate of different materials including printed circuit contacts thereon in conjunction with an actuator assembly including keys arranged so as to provide contact between selected ones of the printed circuit contacts when the keys are depressed. In such arrangements the laminate includes a separate bubble or dome-shaped protrusion in a flexible member disposed under each key such that the protrusion is eventually inverted with increasing pressure on the key to facilitate contact of selected ones of the printed circuit contacts.

While keyboard switch assemblies such as those shown in Lynn et al and Boulanger patents function reasonably well in most respects and for many applications, more extensive use and increased requirements for such equipment have rendered such arrangements generally unsuitable in many instances. Such arrangements, for example, have keys which are too difficult to depress for some applications, have undesirable force-displacement characteristics, have excessive bounce for certain applications and excessive tactile feel for certain applications. Such problems are due in part to the fact that the protrusions must be designed for and must carry a printed circuit pattern at the underside thereof forming sets of contacts for mating engagement with the sets of switch contacts on the substrate. These problems are further added to by the need to make the protrusion forming layer of non-conductive material of a type to which the printed circuit pattern is easily applied.

Accordingly, it would be advantageous to provide an improved keyboard switch assembly.

More specifically, it would be advantageous to provide a keyboard switch assembly having bubble protrusions designed and formed of any appropriate material to optimize the depression and release characteristics thereof without the need to carry printed circuit contacts thereon.

BRIEF DESCRIPTION OF THE INVENTION

Keyboard switch assemblies in accordance with the invention provide key switches which have resilient, flexible bubble protrusions which are free of printed circuit contacts and which are made of any appropriate materials and designed to optimize the operating characteristics thereof. These advantages are accomplished by use of a planar, flexible contact carrying member disposed between the layer containing the bubble protrusions and an apertured dielectric spacer sandwiched with a contact carrying substrate. The contact carrying member has a printed circuit pattern on the underside thereof forming a plurality of sets of switch contacts. Each set of switch contacts is disposed on the opposite side of one of the apertures in the spacer from a mating set of switch contacts on the substrate. When a different key mounted adjacent each of the bubble protrusions is depressed, the protrusion is depressed and eventually inverted so as to flex the flexible contact carrying member downwardly and bring the set of contacts at the underside thereof into engagement with the set of the switch contacts on the substrate at the bottom of the adjacent aperture in the spacer. Upon release of the key, the protrusion returns to its normal, uninverted position, allowing the depressed adjacent portion of the contact carrying member to return to its undeformed position in which the set of contacts at the underside thereof is spaced apart from the adjacent set of switch contacts on the substrate.

BRIEF DESCRIPTION OF THE DRAWING

The foregoing and other objects, features and advantages of the invention will be apparent from the following more particular description of a preferred embodiment of the invention, as illustrated in the accompanying drawing showing a sectional view of a portion of the switch assembly.

DETAILED DESCRIPTION

A keyboard switch assembly 10 in accordance with the invention is designed for use as part of a tone generating telephone as will be recognized from the arrangement of characters on the face thereof. However it will be appreciated by those skilled in the art that the principles of the invention also apply to other types of switch assemblies used in the other types of applications.

The keyboard switch assembly 10 includes an actuator assembly 12 having a plurality of actuator keys 14 held in place by a cover plate 16. The keys 14 reside within apertures 18 in the cover plate 16, and are prevented from removal by a rim 20 extending outwardly at the midsection of each key 14.

A thin, planar substrate 24 has a printed circuit pattern thereon forming a different set of switch contacts 26 at each of a plurality of key receiving regions 28 on the substrate 24. Each set of contacts 26 comprises three different spaced-apart conductive strips including a column conductor 30, a row conductor 32 and a common conductor 34 disposed on substrate 24.

A thin, planar dielectric spacer 36 is mounted on the substrate 24 on the side of the substrate containing the sets of contacts 26. The spacer 36 has a plurality of apertures 38 therein arranged so that a different one of the apertures 38 is disposed adjacent and surrounding a different one of the sets of contacts 26.

A thin, planer layer 40 of polyester film such as Mylar or other suitable flexible resilient material is disposed on an opposite side of spacer 36 from substrate 24. Within each key region 28 opposite conductors 30, 32, 34 a switch closure conductive contact 42 is disposed on a side of layer 40 adjacent conductors 30, 32, 34 in facing relationship thereto. Upon the application of switch actuation pressure to layer 40 at a key region 28, layer 40 is forced into a spacer aperture 38 to bring switch closure contact 42 into conductive mating relationship with the conductors 30, 32 and 34. Switch closure is thus effected.

A thin, planar layer 50 of polyester film such as Mylar, or other suitable flexible, resilient material, typically a few mils thick, is disposed on the opposite side of the layer 40 from spacer 36. The layer 50 is formed with a plurality of bubble or dome-shaped protrusions 52 therein forming a continuation of the layer and extending outwardly from the planar portion of the layer 50 on the opposite side of the layer 50 from the layer 40 and the substrate 24. The protrusions 52 are arranged such that a different one is disposed over each aperture 38 in the spacer 36 so as to reside above and adjacent the set of contacts 26 at the bottom of the aperture 38 as well as the closure contact 42 on layer 40. Each closure contact 42 thus lies beneath a different one of the protrusions 52 so as to be forced into contact with the particular set of contacts 26 therebelow when the protrusion 52 is depressed downwardly and inverted by action of the associated actuator key 14.

The actuator assembly 12 with its included keys 14 and cover plate 16 is mounted on the layer 50 such that a different one of the keys 14 is disposed above each protrusion 52 in the layer 50. A key spring 56 in the form of a coil spring is disposed on the outside of each key 14 so as to extend downwardly from the rim 20 into contact with the layer 50 around the outer periphery of the protrusion 52. The inside of the key 14 has a cylindrical recess 58 within which there is supported a generally cylindrical guide post 60. A follower 62 has an internal aperture 64 which receives guide post 60 in sliding, guiding relation thereto. An actuation spring 66 which is a helical coil spring of smaller diameter than the key spring 56 is disposed so as to extend between the key 14 at the top of the aperture 58 and the follower 62.

Upon manual depression of the key 14, downward travel of the key 14 is permitted against resistance of the spring 56. At the same time the actuation spring 66 forces the follower 62 downwardly against the top of the protrusion 52. Typically, when the key 14 has traveled at least about 50% of its total extent of travel, the protrusion 52 is inverted so as to bring the closure contact at the underside of the layer 40 into contact with the set of contacts 26 on the top surface of the substrate 24.

While the invention has been particularly shown and described with reference to a preferred embodiment thereof, it will be understood by those skilled in the art that various changes in form and details may be made therein without departing from the spirit and scope of the invention. Accordingly, any modifications, variations or equivalent arrangements within the scope of the attached claims should be considered to be within the scope of the invention.

What is claimed is:

1. A switch assembly comprising:

a planar substrate having a conductive circuit pattern printed on a surface thereof, the circuit pattern defining a plurality of sets of switch contacts each set including at least two separate contacts;

a planar dielectric spacer disposed adjacent the surface of the substrate and having a different aperture therethrough at each of the sets of switch contacts;

a thin planar contact carrying dielectric member disposed adjacent the spacer opposite the spacer from the substrate and having a conductive circuit pattern printed on a surface thereof facing the spacer and the substrate to close a set of switch contacts on the substrate upon being forced through an aperture in the spacer and into engagement therewith;

a thin layer of flexible material having a planar portion disposed adjacent the contact carrying member opposite the spacer and having a different protrusion therein adjacent each of the different apertures in the spacer, each of the protrusions being a continuation of the layer and extending outwardly from the layer on the opposite side of the layer from the spacer; and an actuator mechanism including a spring biased key, a follower, and a follower spring providing the sole coupling between the key and follower positioned adjacent each protrusion, the follower engaging the adjacent protrusion with a force that increases in response to actuation of the key by an operator to force said protrusion into engagement with the dielectric member to force the conductive circuit pattern thereon into contact closure engagement with a set of switch contacts, the follower spring limiting the force that can be applied through the follower to the protrusion even though a greater force may be applied to the key.

* * * * *